US010787908B2

(12) United States Patent
Hwang et al.

(10) Patent No.: US 10,787,908 B2
(45) Date of Patent: Sep. 29, 2020

(54) DISK ASSEMBLY FOR GAS TURBINE COMPRESSOR

(71) Applicant: DOOSAN HEAVY INDUSTRIES & CONSTRUCTION CO., LTD., Changwon-si, Gyeongsangnam-do (KR)

(72) Inventors: Kyu Sic Hwang, Changwon-si (KR); Ievdoshyn Andrii, Gimhae-si (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 111 days.

(21) Appl. No.: 15/886,775

(22) Filed: Feb. 1, 2018

(65) Prior Publication Data

US 2018/0223669 A1 Aug. 9, 2018

(30) Foreign Application Priority Data

Feb. 3, 2017 (KR) ..... 10-2017-0015620

(51) Int. Cl.
*F01D 5/08* (2006.01)
*F04D 29/32* (2006.01)

(52) U.S. Cl.
CPC ..... *F01D 5/082* (2013.01); *F04D 29/321* (2013.01); *F05D 2220/32* (2013.01); *F05D 2240/20* (2013.01); *F05D 2260/20* (2013.01)

(58) Field of Classification Search
CPC . F01D 5/005; F01D 5/021; F01D 5/04; F01D 5/06; F01D 5/08; F01D 5/12; F01D 5/14; F01D 5/22; F01D 5/28; F01D 5/30; F01D 5/3007; F01D 5/3023; F04D 29/00; F04D 29/02; F04D 29/04; F04D 29/05; F04D 29/06; F04D 29/08; F04D 29/18; F04D 29/26; F04D 29/40; F04D 29/58; F04D 29/60; F04D 29/66; F04D 29/70
USPC ..... 415/115, 116
See application file for complete search history.

(56) References Cited

U.S. PATENT DOCUMENTS 2,650,017 A * 8/1953 Pedersen ..... F01D 5/066 416/244 R
3,656,861 A * 4/1972 Zagar ..... F04D 29/2277 415/109
4,415,310 A 11/1983 Bouiller et al.
5,317,877 A * 6/1994 Stuart ..... F02C 7/185 60/736

(Continued)

FOREIGN PATENT DOCUMENTS

DE 19617539 A1 * 11/1997 ..... F01D 5/063
DE 19617539 A1 11/1997

(Continued)

OTHER PUBLICATIONS

A Japanese Office Action dated Jan. 29, 2019 in connection with Japanese Patent Application No. 2018-017712 which corresponds to the above-referenced U.S. application.

(Continued)

*Primary Examiner* — Richard A Edgar
*Assistant Examiner* — Maranatha Boardman
(74) *Attorney, Agent, or Firm* — Invenstone Patent, LLC

(57) ABSTRACT

Disclosed herein is a disk assembly for a gas turbine compressor, which comprises a partition wall formed to partition a space between disks for a gas turbine compressor to optimize a cooling fluid path.

20 Claims, 9 Drawing Sheets

(56) References Cited

U.S. PATENT DOCUMENTS

| | | | | |
|---|---|---|---|---|
| 6,217,280 | B1 * | 4/2001 | Little | F01D 5/084 415/115 |
| 6,857,851 | B2 * | 2/2005 | Avignon | F01D 5/082 415/116 |
| 2009/0282834 | A1 * | 11/2009 | Hein | F01D 5/081 60/772 |
| 2016/0146010 | A1 | 5/2016 | Costamagna et al. | |

FOREIGN PATENT DOCUMENTS

| | | | |
|---|---|---|---|
| EP | 1329591 | A1 | 7/2003 |
| EP | 2025867 | A1 | 2/2009 |
| EP | 2264281 | A2 | 12/2010 |
| EP | 2679771 | A1 | 1/2014 |
| JP | H11-315800 | A | 11/1999 |
| JP | 2014-005829 | A | 1/2014 |

OTHER PUBLICATIONS

European Search Report dated Jun. 11, 2018 in corresponding European Patent Application No. 18154861.1.

* cited by examiner

[FIG. 1]
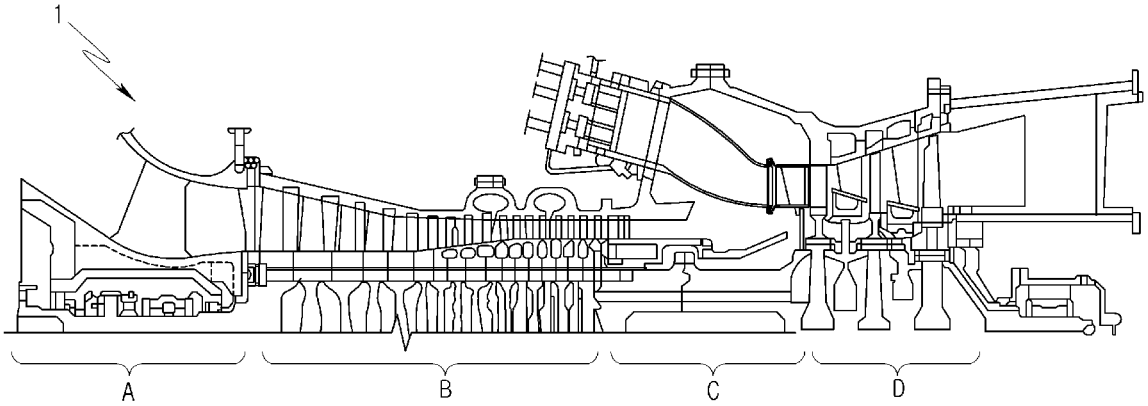

[FIG. 2]
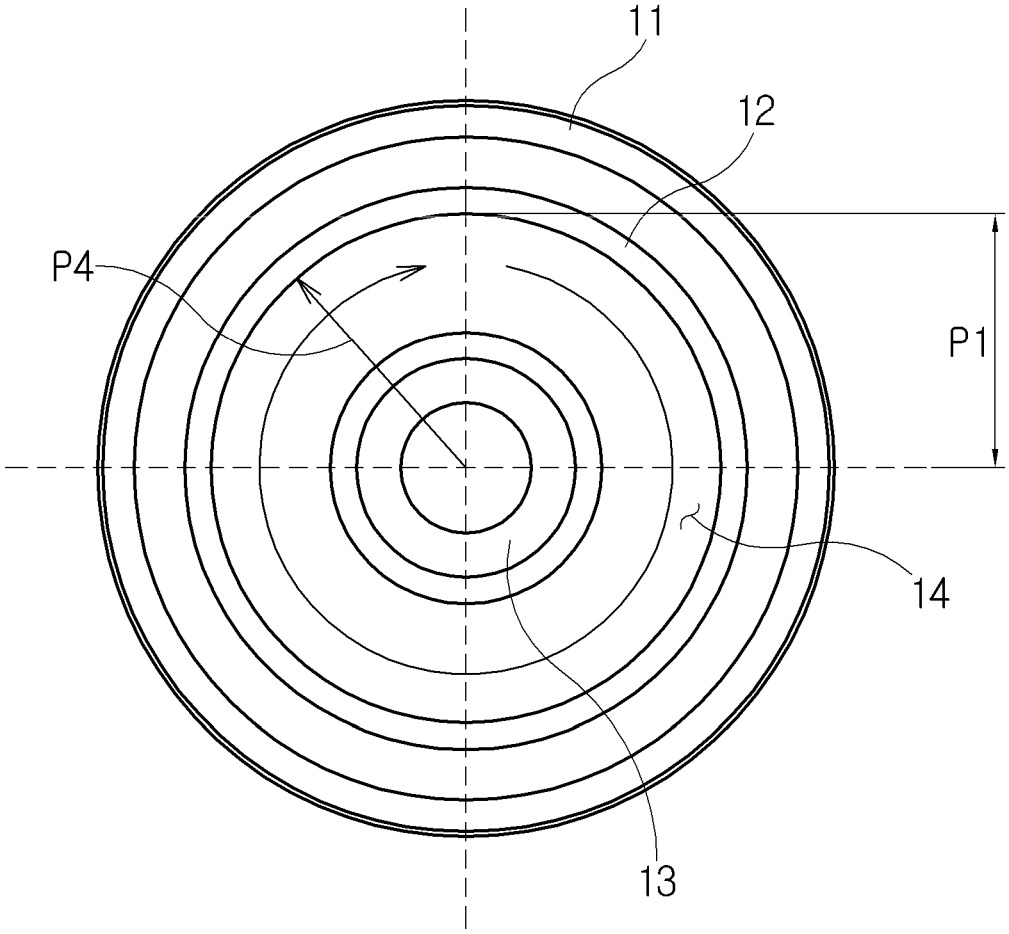

[FIG. 3]
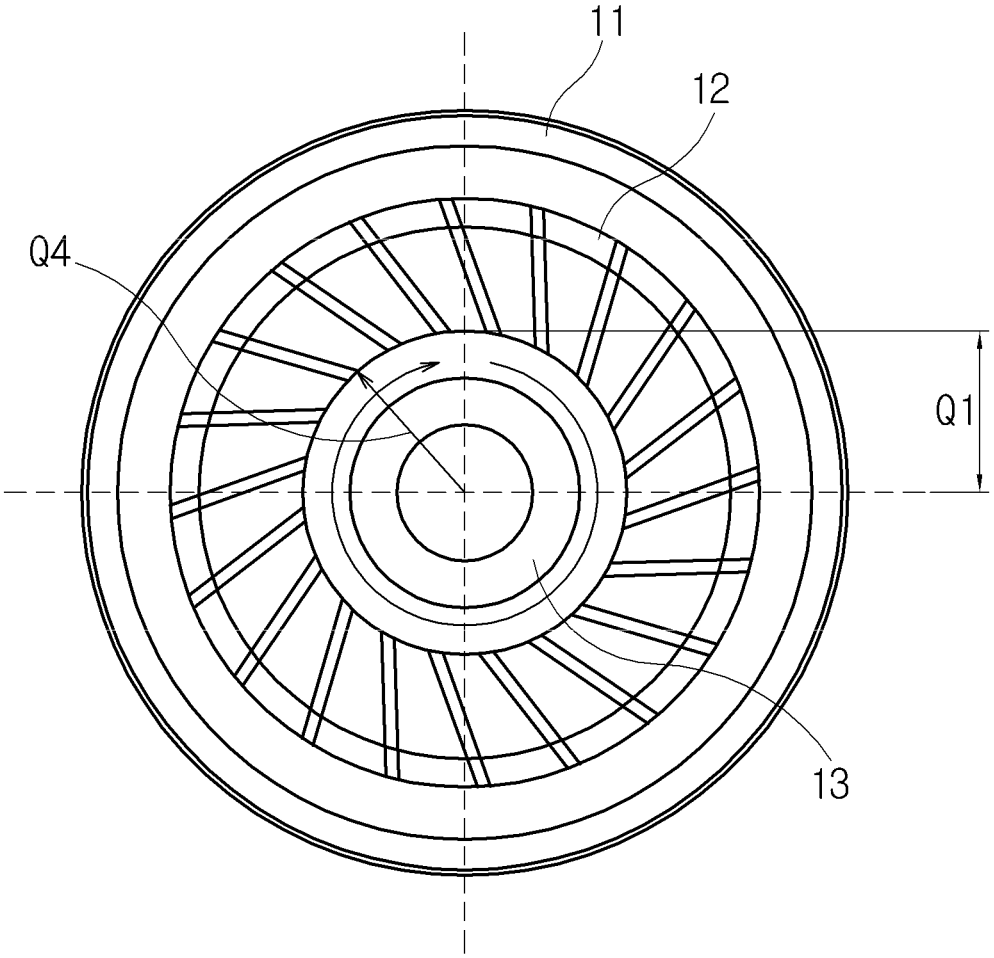

[FIG. 4]
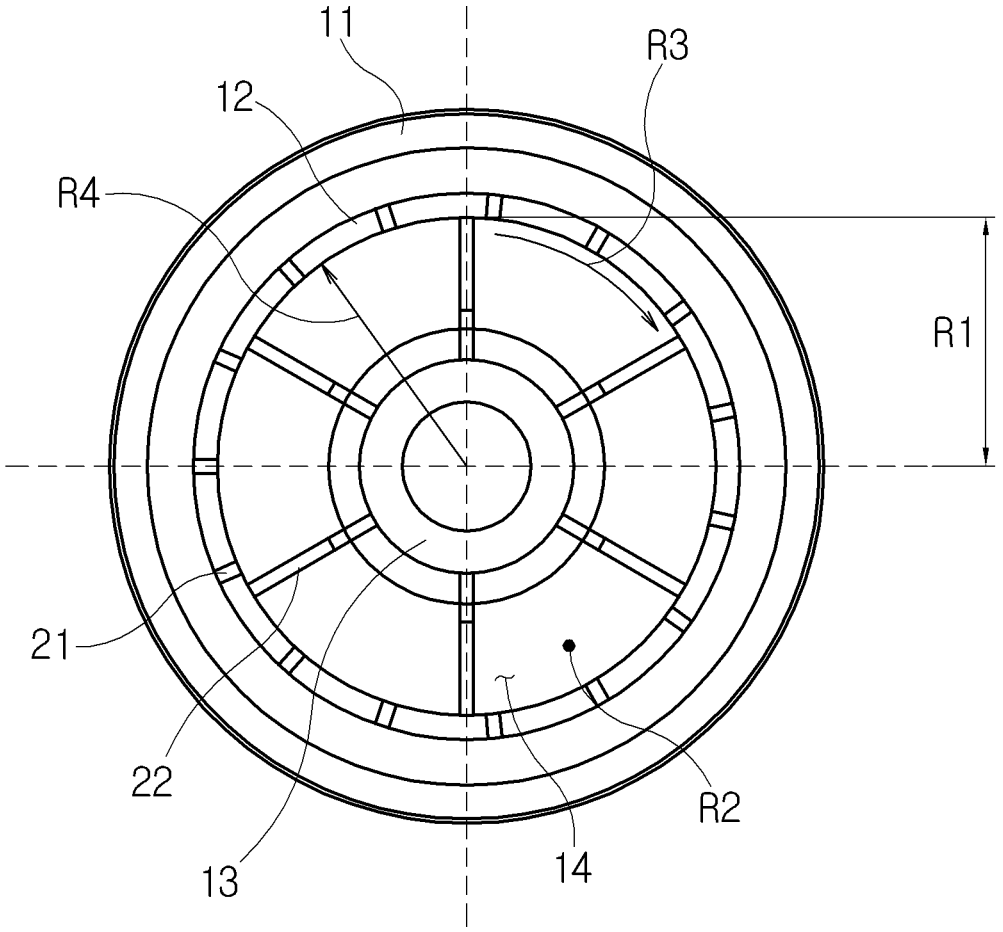

[FIG. 5]
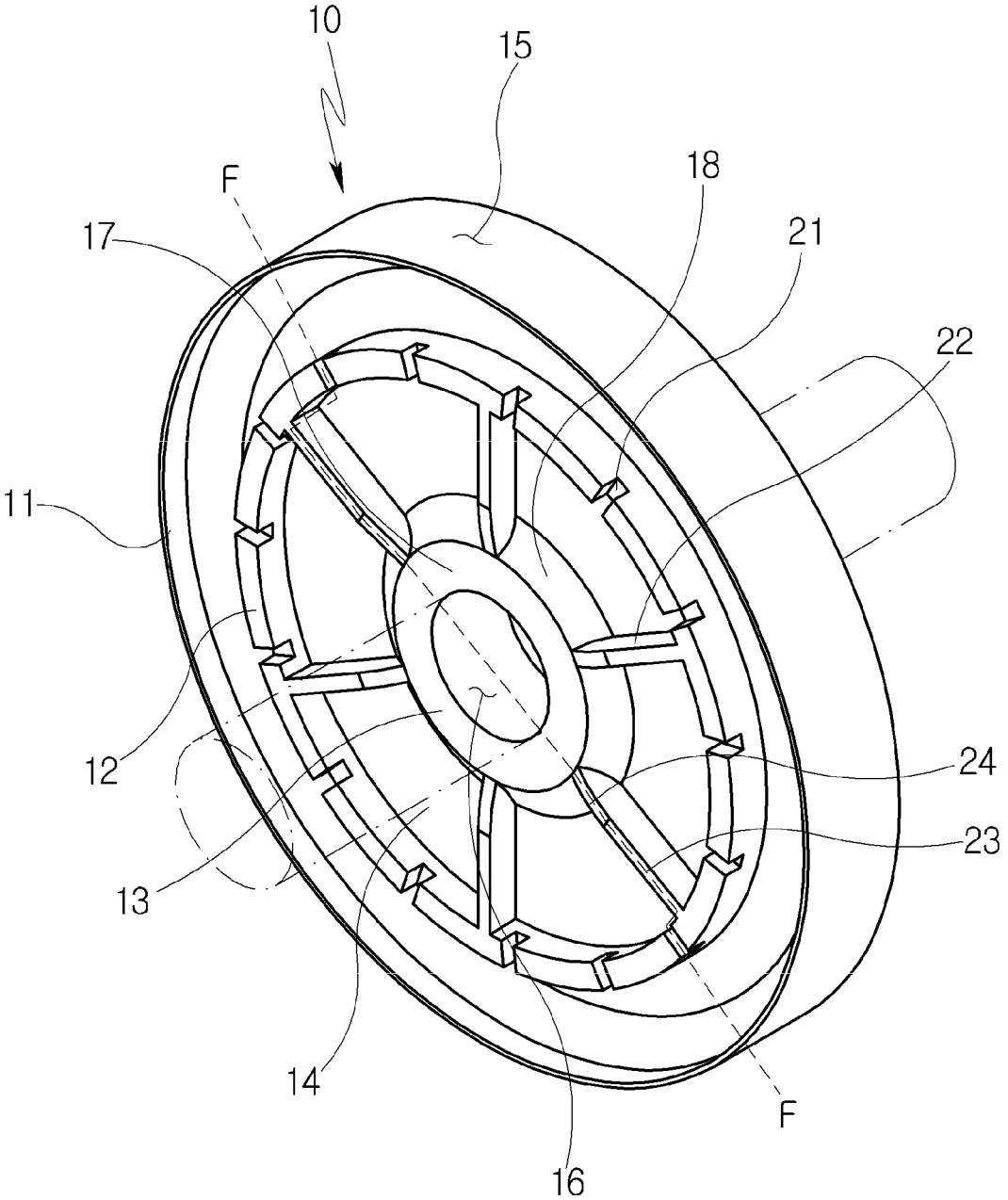

[FIG. 6]
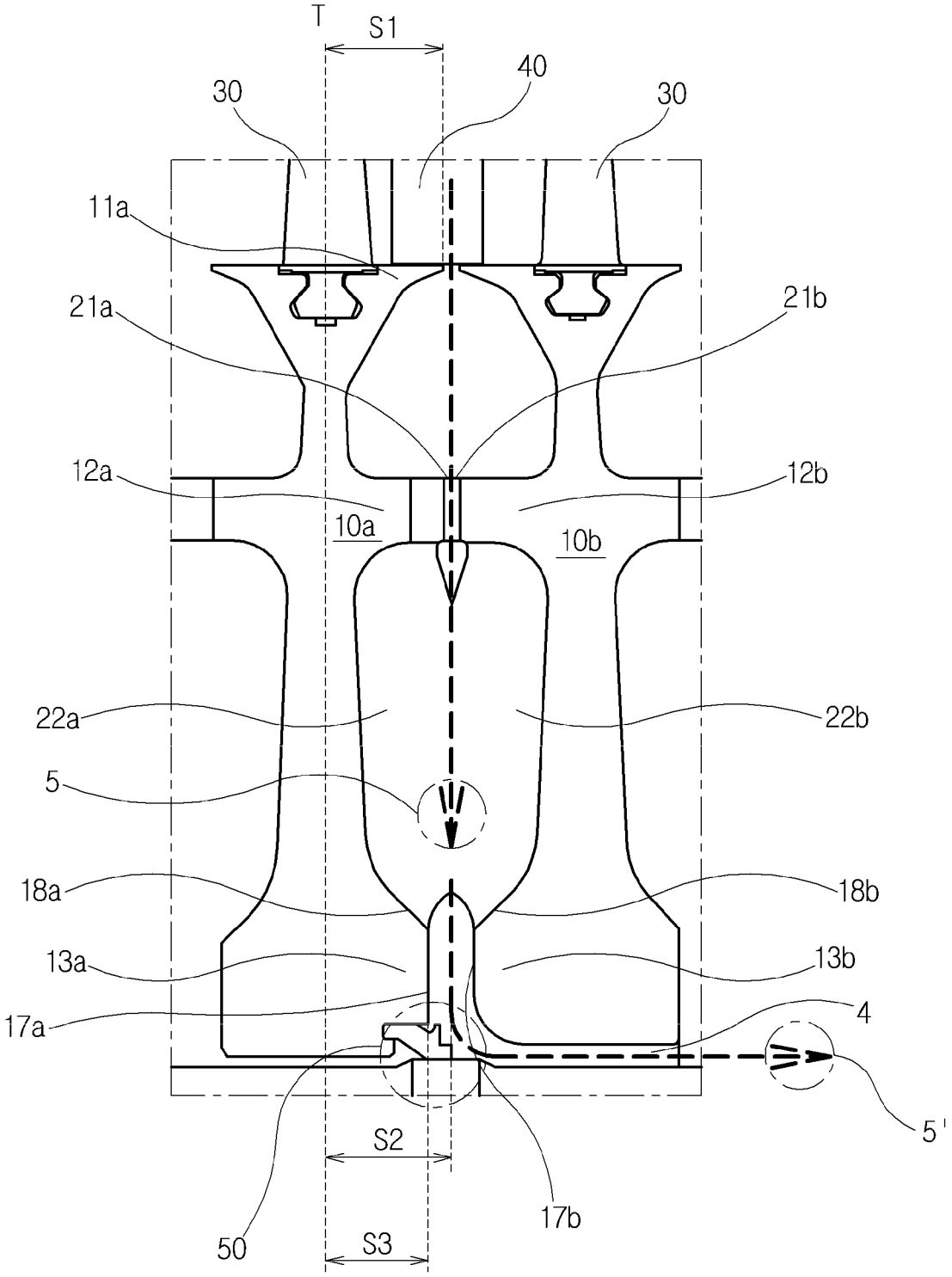

[FIG. 7]
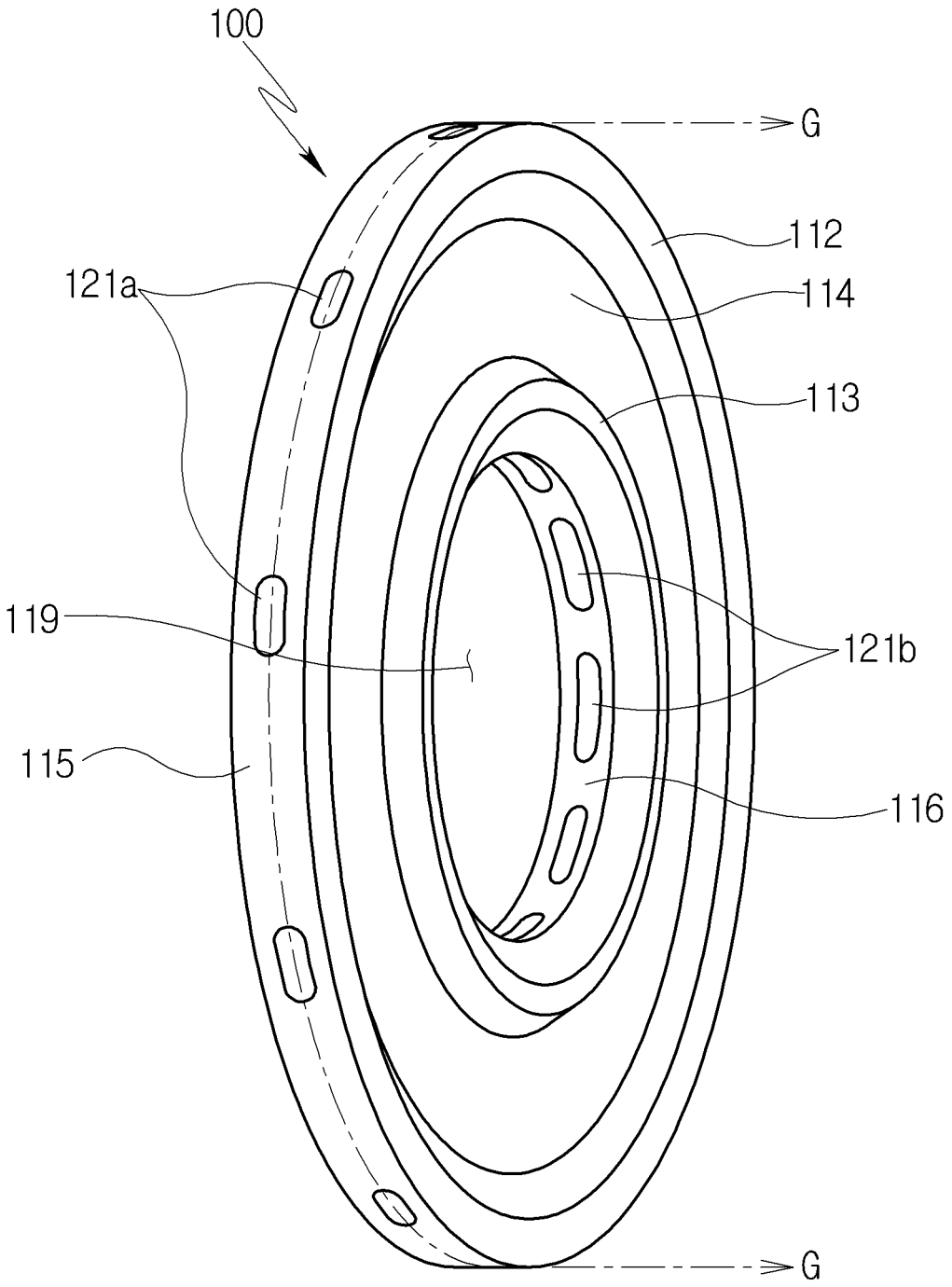

[FIG. 8]
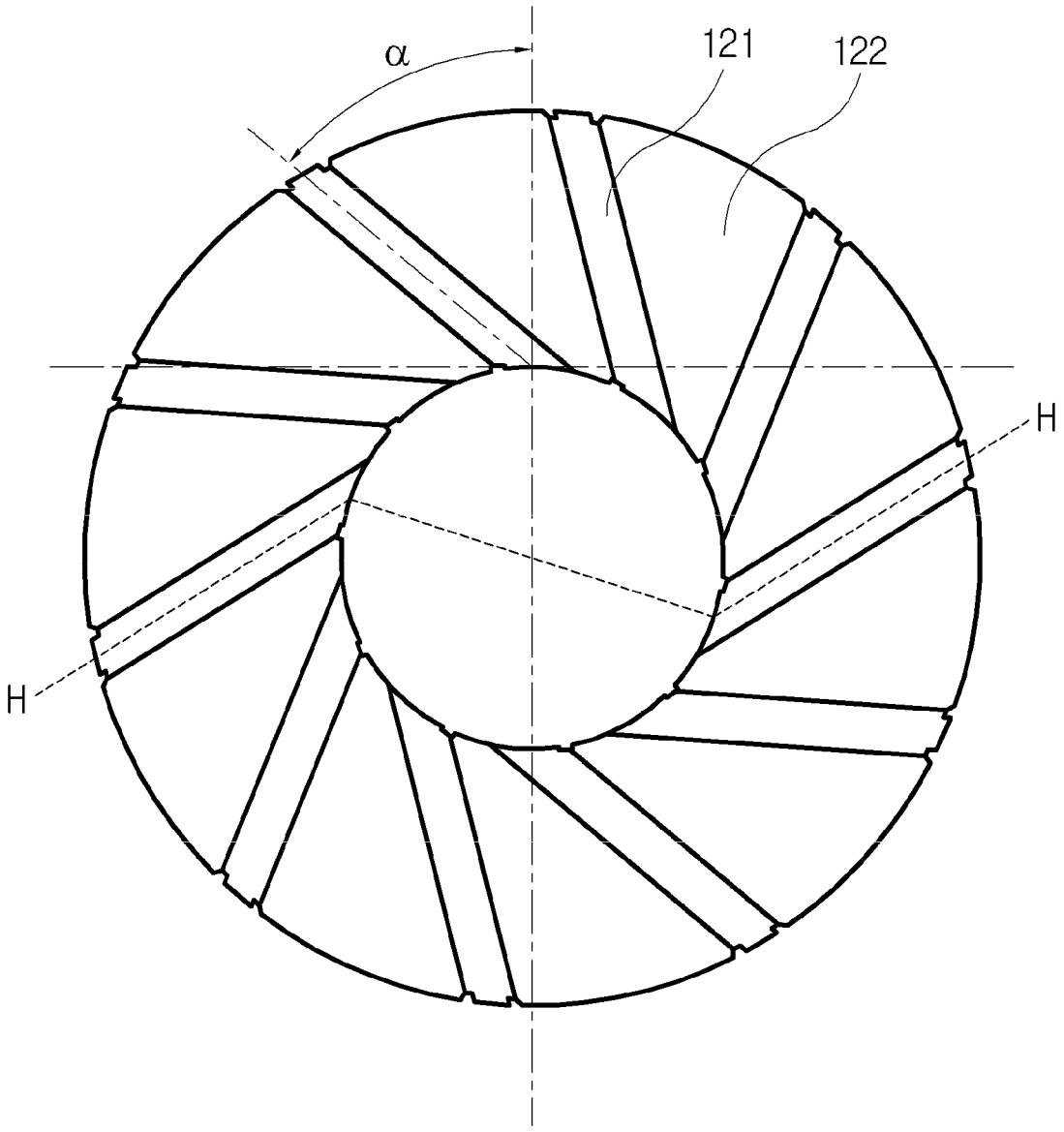

[FIG. 9]
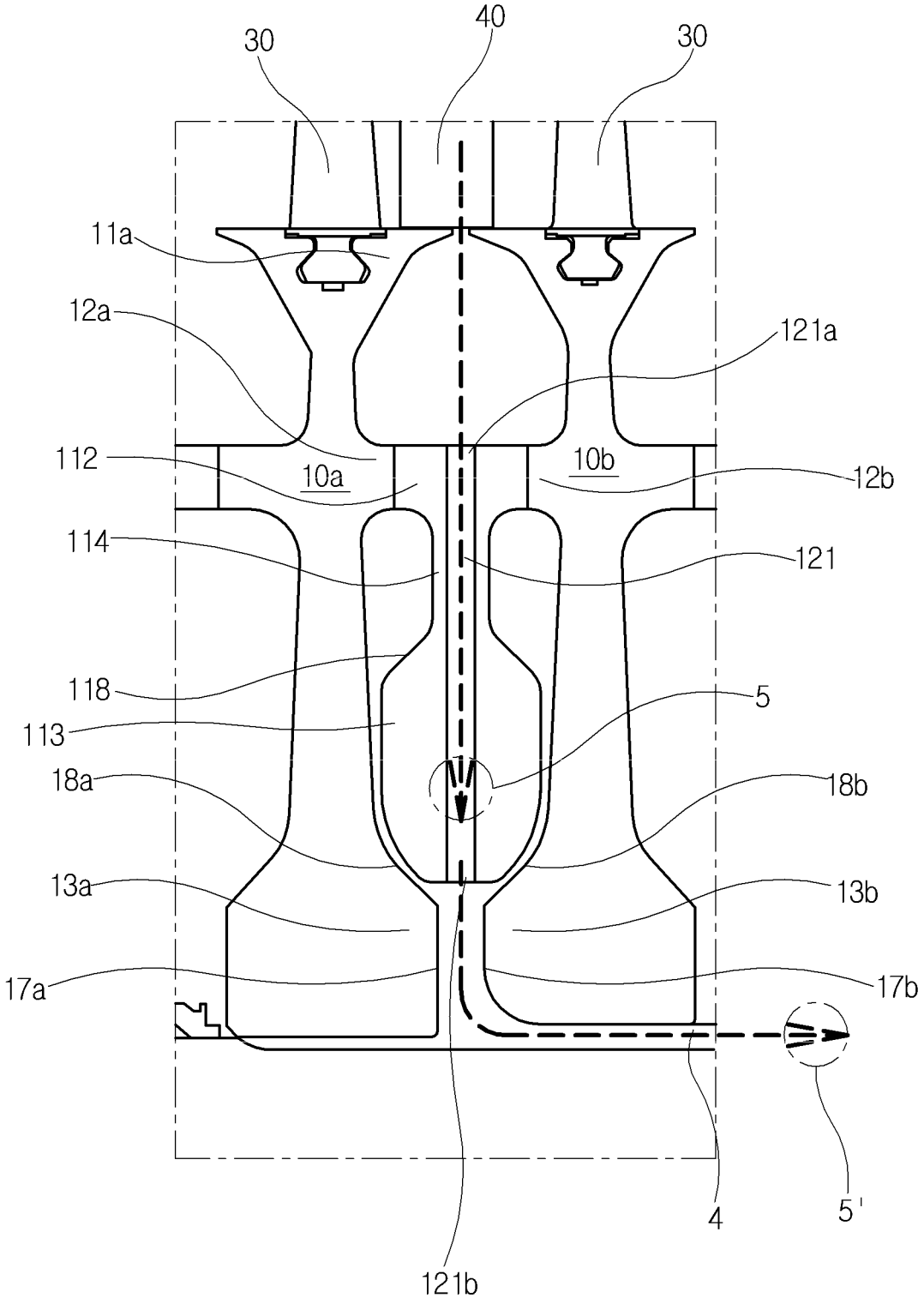

DISK ASSEMBLY FOR GAS TURBINE COMPRESSOR

CROSS-REFERENCE(S) TO RELATED APPLICATIONS

This application claims priority to Korean Patent Application No. 10-2017-0015620, filed on Feb. 3, 2017, the disclosure of which is incorporated herein by reference in its entirety.

BACKGROUND OF THE DISCLOSURE

Field of the Disclosure

Exemplary embodiments of the present disclosure relate to a disk assembly for a gas turbine compressor, and more particularly, to a disk assembly for a gas turbine compressor, which comprises a partition wall formed to partition a space between disks for the gas turbine compressor to optimize a cooling fluid path.

Description of the Related Art

As is widely known, a gas turbine generally comprises a compressor that compresses air, a combustor that mixes the compressed air with fuel for ignition, and a turbine blade assembly that produces electric power.

The combustor is operated at a high temperature above 2,500° F. The vane and blade of the turbine are typically exposed to the high temperature, and they are therefore made of a material resistant to high temperature. In addition, the vane and blade of the turbine are provided with a cooling system that prolongs their life and reduces a possibility of damage due to excessive temperature.

One of the methods for cooling a turbine section exposed to high temperature using this cooling system is to secure a cooling fluid from a compressor section to supply the cooling fluid to a turbine section. In the compressor of the gas turbine which uses this cooling method, birth parts of each disk are coupled to each other and the disk has an opening formed at a portion thereof to form a passage of cooling air.

Cooling air serves to cool the turbine section in such a manner that a portion of the air delivered to the combustor through the compressor is introduced between disk rims which are outer peripheral portions of the disks of the compressor, thereby getting to the turbine section. The cooling air is introduced into a first space between each of the disk rims and an associated one of the birth parts, is introduced into a second space between the hirth part and the center of the associated disk through, the opening, and is delivered to the turbine section through a passage that is formed between a root part of the disk of the compressor and a rotary shaft to extend to the turbine section.

SUMMARY OF THE DISCLOSURE

However, in this conventional method, cooling air rapidly rotates in the second space along with the rotation of the disks of the compressor. Hence, the rotation of cooling air between the disks substantially interrupts the introduction of air into each disk from outside of the disk.

In addition, the disk must be processed to form an opening thereon. However, there is a problem in that this processing is commonly performed using a drill and it is very difficult to process the disk according to the position or direction of the opening.

An object, of the present disclosure is to provide a disk assembly for a gas turbine compressor, which comprises corresponding grooves formed at positions in which, facing hirth parts meet each other and a partition wall tor preventing cooling air from rotating in a space between disks.

Other objects and advantages of the present disclosure may be understood by the following description, and become apparent with reference to the embodiments of the present disclosure. Also, it is obvious to those skilled in the art to which the present disclosure pertains that the objects and advantages of the present disclosure may be realized by the means as claimed and combinations thereof.

In accordance with one aspect of the present disclosure, a disk for a gas turbine compressor comprises a root part assembled to a rotary shaft, a circular base plate extending radially from the root part and having a thickness smaller than that of the root part in a direction of the rotary shaft, a disk rim forming an outer periphery of the base plate and extending bidirectionally in a direction parallel to the direction of the rotary shaft, and a circular birth part protruding bidirectionally from the base plate in the direction parallel to the direction of the rotary shaft and positioned between the root part and the disk rim, wherein the hirth part has a plurality of grooves formed at an end thereof, the grooves being circumferentially spaced apart from each other, and at least one partition wall is formed to extend from the root part to the hirth part.

The number of partition walls may be six.

The partition walls may be spaced circumferentially at the same distance on the base plate.

The partition wall may comprise a bonding portion having the same height as a protruding height of the hirth part from the base plate.

The partition wall may further comprise an inclined portion extending from the bonding portion to the root part and having a height gradually lowered.

A protruding length of the hirth part in the direction of the rotary shaft from the base plate may be longer than protruding lengths of the disk rim and the root part in the direction of the rotary shaft from the base plate.

In accordance with another aspect of the present disclosure, a disk assembly for a gas turbine compressor comprises a first disk and a second disk adjacent to the first disk, each comprising a root part assembled to a rotary shall, a circular base plate extending radially from the root part and having a thickness smaller than that of the root part in a direction of the rotary shaft, a disk rim forming an outer periphery of the base plate and extending bidirectionally in a direction parallel to the direction of the rotary shaft, and a circular birth part protruding bidirectionally from the base plate in the direction, parallel to the direction of the rotary shaft and positioned between the root part and the disk rim, wherein a first hirth part of the first disk is coupled to a second hirth part of the second disk, the first hirth part has a plurality of first grooves formed at an end thereof, the first grooves being circumferentially spaced apart from each other, at least one first partition wall is formed to extend from a first root part to the first hirth part, the second birth part has a plurality of second grooves formed at an end thereof, the second grooves being circumferentially spaced apart from each other, and at least one second partition wall is formed to extend from a second root part to the second hirth part.

The first and second grooves may be formed at corresponding positions, and the first and second partition walls may be formed at corresponding positions.

The first partition wall may comprise a first bonding portion having the same height as a protruding height of the first hirth part from a first base plate of the first disk, the second partition wall may comprise a second bonding portion having the same height as a protruding height of the second hirth part from a second base plate of the second disk, and the first and second bonding portions may be bonded to each other to block a flow of air in a disk space defined between the coupled first and second birth, parts and the rotary shaft.

The first partition wall may further comprise a first inclined portion extending horn the first bonding portion to the first root part and having a height gradually lowered, and the second partition wall may further comprise a second, inclined portion extending from the second bonding portion to the second root pail and having a height gradually lowered.

The first partition walls and the second partition walls may each be six.

The respective first and second partition walls may be spaced circumferentially at the same distance on respective first and second base plates.

A protruding length of the first hirth part in the direction of the rotary shaft from a first base plate of the first disk may be longer than protruding lengths of a first disk rim and the first root part of the first disk in the in the direction of the rotary shaft from the first base plate, and a protruding length of the second hirth part in the direction of the rotary shaft from a second base plate of the second disk may be longer than protruding lengths of a second disk rim and the second root part of the second disk in the in the direction of the rotary shaft from the second base plate.

In accordance with a further aspect of the present disclosure, a disk assembly for a gas turbine compressor comprises a first disk and a second disk adjacent to the first disk, each comprising a root part assembled to a rotary shaft, a circular base plate extending radially from the root part and having a thickness smaller than that of the root part in a direction of the rotary shaft, a disk rim forming an outer periphery of the base plate and extending bidirectionally in a direction, parallel to the direction of the rotary shaft, and a circular hirth part protruding bidirectionally from the base plate in the direction parallel to the direction of the rotary shaft and positioned between the root part and the disk rim, wherein an inter-disk is mounted between the first disk and the second disk, and air outside the first and second disks flows between a first root part of the first disk and a second root part of the second disk through a plurality of passages formed, to pass through the inter-disk.

The inter-disk may have an opening formed in a center thereof, the opening having a diameter greater than those of the first and second root parts.

The inter-disk may comprise an air flow plate having a plurality of passages therein, an outer ring formed on an outer periphery of the air flow plate and having an inlet formal for introduction of air, and an inner ring formed on an inner periphery of the air flow plate and having an outlet formed for discharge of air.

The outer ring may be coupled between a first birth part of the first disk and a second hirth part of the second disk.

The plurality of passages may be formed obliquely to a radial direction.

The plurality of passages may be inclined at an angle of 40° to the radial direction.

Partitions may each be provided between the plurality of passages.

It is to be understood that both the foregoing general description and the following detailed description of the present disclosure are exemplary and explanatory and are intended to provide farther explanation of the disclosure as claimed.

BRIEF DESCRIPTION Of THE DRAWINGS

The above and other objects, features and other advantages of the present disclosure will be more clearly understood from the following detailed description taken, in conjunction with the accompanying drawings, in which:

FIG. 1 is a cross-sectional view schematically illustrating an upper half of an overall gas turbine;

FIG. 2 is a view for explaining a state, in which compressed air in a disk space rotates, and calculation of its energy in a disk assembly for a gas turbine compressor in which a through-passage for a flow of a cooling fluid is not formed in a disk;

FIG. 3 is a view for explaining a state, in which compressed air in a disk space rotates, and calculation of its energy in a disk assembly for a gas turbine compressor in which a through-passage for a flow of a cooling fluid is formed in a disk;

FIG. 4 is a view for explaining a state, in which compressed air in a disk space rotates, and calculation of its energy in a disk assembly for a gas turbine compressor according to an embodiment of the present disclosure;

FIG. 5 is a perspective view illustrating one surface of one disk comprised in the disk assembly for a gas turbine compressor according to the embodiment of the present disclosure;

FIG. 6 is a cross-sectional view taken along line F-F of FIG. 5 in the disk assembly for a gas turbine compressor according to the embodiment of the present disclosure;

FIG. 7 is a perspective view illustrating an inter-disk according to an embodiment of the present disclosure;

FIG. 8 is a cross-sectional view taken along line G-G of FIG. 7 in the inter-disk according to the embodiment of the present disclosure; and FIG. 9 is a cross-sectional view taken along line H-H of FIG. 8 in the disk assembly comprising the inter-disk according to the embodiment of the present disclosure.

DESCRIPTION OF SPECIFIC EMBODIMENTS

Reference will now be made in detail to exemplary embodiments of the present disclosure, examples of which are illustrated in the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Throughout the disclosure, like reference numerals refer to like parts throughout the various figures and embodiments of the present disclosure.

Hereinafter, a disk assembly tor a gas turbine compressor according to exemplary embodiments of the present disclosure will be described in detail with reference to the accompanying drawings.

FIG. 1 is a cross-sectional view schematically illustrating an upper half of a gas turbine 1. The gas turbine 1, comprises an intake section A, a compressor section B, a combustor section C, and a turbine section D. Air introduced through the intake section A is compressed by the blade and vane of the compressor section B, and the compressed air is supplied to the combustor section C. The supplied air is combusted in the combustor section C is delivered to the turbine section D in a high-temperature and high-pressure state. Thus, the rotor of the turbine section D is rotated and the generator connected thereto is operated.

In this case, the blade and vane of the turbine section D are continuously exposed to heat, resulting in damage due to heat. To prevent this damage, it may necessary to supply a cooling fluid to the blade and the vane.

The gas turbine 1 according to the present disclosure utilizes a method in which a portion of the air compressed by a compressor flows into disks of the compressor to move to the turbine section D along a rotary shaft and is then delivered to a targeted blade 30 and vane 40 of the turbine.

To deliver a cooling fluid to the blade and vane of the turbine, it may be important for the cooling fluid to smoothly flow between the rotating disks of the compressor. In this regard, it may be expected that how much introduced air is blocked by each model by calculating kinetic energy of air rotating in a disk space in FIGS. 2 and 3.

FIG. 2 is a view for explaining a state, in which compressed air in a disk space rotates, and calculation of its energy in a disk assembly for a gas turbine compressor.

A disk space is defined in an interior portion in which two base plates 14 face each other between a hirth part 12 and a root part 13 of a disk 10. Air is contained in the disk space by the volume thereof. For a disk model with a radius PI of 0.57 m (meter) to the hirth part 12, the rotational velocity y of compressed air is about 213.6 m/s, the centrifugal force P4 thereof is about 408,223.3 kg·m/s$^2$, and the kinetic energy thereof is about 1,392,041.5 J.

FIG. 3 is a view for explaining a state, in which the compressed air in the disk space rotates, and calculation of its energy in a disk assembly for a gas turbine compressor according to the present, disclosure. This disk model has a plurality of openings for communication between the hirth part 12 and a portion adjacent to the outer periphery of the root part 13. In the disk model, air is introduced into each of the openings from outside of the opening, and a disk space has a radius Q1 of 0.35 m set smaller than that of FIG. 2.

The disk space is defined in an interior portion in which, the two base plates 14 face each other. The disk space has the radius Q1 of 0.35 m to the outer periphery thereof. Air is contained in the disk space by the volume thereof. For the disk model with the radius Q1 of 0.35 m, the rotational velocity v of compressed air is about 132 m/s, the centrifugal force Q4 thereof is about 73,180.8 kg·m/s$^2$, and the kinetic energy thereof is about 160,264 J.

When the disk space is reduced or the amount of rotation of air is reduced while the path of air introduced into the disk is secured, the kinetic energy of rotating air is reduced to interrupt the introduction of air less in the case of the disk model of FIG. 3 than that of FIG. 2. The model of FIG. 4 has been devised based on these models.

FIG. 4 is a view for explaining a state, in which compressed air in a disk space rotates, and calculation of its energy in a disk assembly for a gas turbine compressor according to an embodiment of the present disclosure.

In the embodiment, the disk 10 is entirely outlined based on the disk model of FIG. 2. Additionally, a plurality of grooves 21 is formed in the hirth part 12 and partition walls 22 extending radially are formed between the hirth part 12 and the root part 13.

In such a configuration, a space, which has a radius R1 of 0.57 m and is defined between the two base plates 14, is equally partitioned into six by the partition walls 22. The air present in the equally partitioned, spaces has a mass R2 of about 0.85 kg, and the rotatably movable distance R3 of air is 0.56 m. In this case, the rotational velocity v of compressed air is about 213.6 m/s, the centrifugal force R4 thereof is about 68,037.2 kg·m/s$^2$, where the value is obtained by multiplying the mass E2 by the square of the velocity v and then dividing the same by the radius R1, and the kinetic energy thereof is about 38,100.8 J.

According to the embodiment of the present disclosure, the centrifugal force and kinetic energy of air are significantly reduced. Therefore, the compressed air introduced from the plurality of grooves 21 may smoothly flow into the disk.

FIG. 5 is a perspective view illustrating a surface of one disk comprised in the disk assembly for a gas turbine compressor, according to the embodiment of the present disclosure.

A disk rim 11 forms the outer periphery of the disk 10. The blade 30 may be mounted on an outer surface 15 of the disk rim 11, but this mounting structure is omitted for explaining only a structure of the disk in the drawing.

The root part 13 has an opening formed in the center thereof for insertion of a rotary shaft. The opening of the root part 13 may be defined by an inner surface 16 of the root part 13. The basic frame of the disk is completed by forming a base plate 14 having a surface extending radially from the root part 13, which is mounted on the rotary shaft, to the disk rim 11. The hirth part 12 is formed between the disk rim 11 and the root part 13, and is coupled to a hirth past of an adjacent disk.

A plurality of partition walls may be ionised between the root part 13 and the hirth part 12. Each of the partition walls extends radially between the root part 13 and the hirth part 12.

In the disk assembly according to the embodiment of the present disclosure, the plurality of partition walls may be six partition walls 22 arranged in the same distance. In the ease where the plurality of partition walls are six as in the present embodiment, the disk assembly may have an excellent effect of balancing the flow of a cooling fluid without an excessive increase in weight. That is, since the kinetic energy of air rotating between a disk and another disk and between a partition wall and another partition wall is reduced to about 38,100.8 J as in the above experimental result while the weight of the disk assembly is minutely increased, it may be possible to minimize a pressure loss of compressed air passing through the disk from outside to inside. Each of the disk rim 11, the root part 13, and the hirth part 12 therebetween has a shape protruding from the base plate 14. However, the disk rim 11 as an outer peripheral portion and the root part 13 as a center portion are lower in height than the hirth part 12 serving as a coupling portion between the disks. Preferably, each of the partition walls 22 extending to the root part 13 at the same height as the hirth part 12 comprises a bonding portion 23, which has the same height as the hirth part 12, and an inclined portion 24 which is gradually lowered to the height of the root part 13.

In detail, one end of the partition wall 22 is connected to an inclined surface of the root part 13 and the other end thereof is connected to the inner surface of the hirth part 12. However, since the height from the point, at which the inclined surface 18 of the root part 13 meets an upper surface 17 of the root pan 13, to a center line T of the base plate 14 is lower than the height from the bonding portion 23 to the center line T, the inclined portion 24 is required to compensate for a difference in height. In this case, the bonding portion 23 is a necessary component to prevent rotation of air, whereas the inclined portion 24 is a subsidiary component.

FIG. 6 is a cross-sectional view taken along line F-F of FIG. 5 in the disk assembly for a gas turbine compressor according to the embodiment of the present disclosure. In the disk assembly, a first disk 10*a* is adjacent to a second disk 10*b*, hirth parts 12*a* and 12*b* are coupled to each other, and a first groove 21*a* of the first disk 10*a* meets a second groove 21*b* of the second disk 10*b* to form an opening. Compressed air is introduced into the disks from outside of the disks in the direction indicated by a dotted arrow 5. The air introduced into the disk space immediately flows between upper surfaces 17*a* and 17*b* of root parts 13*a* and 13*b* to flow to the turbine section through a cooling passage 4 in the direction indicated by an arrow 5', and is in the state in which the rotation of the air is restricted by first and second partition walls 22*a* and 22*b*.

The distance S1 from a center line T to the end of a disk rim 11*a* may be slightly shorter than the distance S2 from the center line T to the end of the hirth part 12*a* to form a space for introduction of air.

The distance S3 from the center line T to the end of the root part 13*a* may be slightly shorter than the distance S2 from the center line T to the end of the hirth part 12*a* to form a space for discharge of air.

The disks 10*a* and 10*b* are assembled to a rotary shaft by a fastener 50, and the cooling passage 4 is formed between the rotary shaft and the root part of each disk and extends to the turbine section.

FIG. 7 is a perspective view illustrating an inter-disk 100 according to an embodiment of the present disclosure. The inter-disk 100 is mounted in the disk space between the first disk 10*a* and the second disk 30*b* to prevent rotation of compressed air. In the embodiment, the inter-disk 100 is inserted into the disk space to reduce rotation of air, unlike the embodiment of FIGS. 4 to 6 in which the shape of the disk 10 is modified.

The inter-disk 100 has an opening 119 formed in the center thereof, and the opening 119 has a diameter greater than the outer diameter of the upper surface 17*a* or 17*b* of the root part 13*a* or 13*b* of each disk 10*a* or 10*b*. This may enable the air in the disk to be much less affected by the rotation of the compressor in such a manner that, when compressed air is delivered from inlets 121*a* formed on an outer peripheral surface 115 of the inter-disk 100 to outlets 121*b* formed on an inner peripheral surface 116, the air is immediately supplied to the root part 13*a* or 13*b* as a center portion of the disk.

The inter-disk 100 comprises an air flow plate 114 that has a plurality of passages 121 therein; an inner ring 113 that is formed on the inner periphery of the air flow plate 114, defines the boundary of the opening 119, and has outlets 121*b* formed thereon; and an outer ring 112 that is formed on the outer periphery of the air flow plate 114 and has inlets 121*a* formed thereon.

FIG. 8 is a cross-sectional view taken along line G-G of FIG. 7 in the inter-disk according to the embodiment of the present disclosure.

The outer ring 112 of the inter-disk 100 is coupled between the first hirth part 12*a* of the first disk 10*a* and the second hirth part 12*b* of the second disk 10*b*. In this case, their coupling may be spline-coupling, similar to typical coupling between hirth parts.

Preferably, the plurality of passages 121 are formed obliquely to the radial direction in the air flow plate 114 of the inter-disk 100. Preferably, each of the passages 121 has an angle of inclination α of 40° to the radial direction. This is to consider the flow path of air according to the rotation of the compressor. When the angle of inclination α of the passage is 40°, a pressure drop becomes minimum.

Each of the passages 121 may be processed in a slot form to secure the stable structure of the inter-disk 100. The plurality of passages 121 are preferably formed, and the number of the passages 121 is ten (10) in one example.

Partitions 122 are formed between the passages 121, and the number of partitions is necessarily equal to the number of passages.

FIG. 9 is a cross-sectional view taken along line H-H of FIG. 8 in the disk assembly comprising the inter-disk according to the embodiment of the present disclosure.

Compressed air flows through the passages 121 of the inter-disk 100 from the outside of the disk 10*a* or 10*b* in the direction indicated by an arrow 5. Then, the air is supplied to the turbine section D through a cooling passage 4 formed between the disk 10*b* and the rotary shaft.

The outer ring of the inter-disk 100 is spline-coupled between the hirth parts 12*a* and 12*b* of the disks 10*a* and 10*b*. The inner ring 113 has outlets 121*b* formed therein, and the inner periphery of the inner ring 113 is further away from the rotary shaft than the point at which the upper surfaces 17*a* and 17*b* of both root parts 13*a* and 13*b* meet the inclined surfaces 18*a* and 18*b*.

Since the outlets 121*b* are formed adjacent to the upper surfaces 17*a* and 17*b*, the compressed air passing through the passages 121 may immediately flow to the cooling passage 4. This structure may significantly reduce a pressure loss of compressed air.

As is apparent from the above description, a disk assembly for a gas turbine compressor according to exemplary embodiments of the present disclosure may prevent a cooling fluid from rotating in a space between disks to promote the introduction of cooling air into each of the disks from outside of the disk.

In addition, the disk assembly for a gas turbine compressor is advantageous in that it may be easily manufactured since an opening for communication of a cooling fluid is not separately processed in the disk.

While the present disclosure has been described with respect to the specific embodiments, it will be apparent to those skilled in the art that various changes and modifications may be made without departing from the spirit and scope of the disclosure as defined in the following claims.

What is claimed is:

1. A disk assembly for a gas turbine compressor, comprising:

a first disk and a second disk adjacent to the first disk, each comprising a root part assembled to a rotary shaft, a circular base plate extending radially from the root part and having a thickness smaller than that of the root part in a direction of the rotary shaft, a disk rim forming an outer periphery of the base plate and extending bidirectionally in a direction parallel to the direction of the rotary shaft, and a circular hirth part protruding bidirectionally from the base plate in the direction parallel to the direction of the rotary shaft and positioned between the root part and the disk rim, wherein:

an inter-disk is mounted between the first disk and the second disk;

air outside the first and second disks flows between a first root part of the first disk and a second root part of the second disk through a plurality of passages formed to pass through the inter-disk;

the inter-disk has an opening formed in a center thereof, the opening having a diameter greater than those of the first and second root parts;

the inter-disk comprises:

an air flow plate having a plurality of passages therein;

an outer ring formed on an outer periphery of the air flow plate and having an inlet formed for introduction of air; and an inner ring formed on an inner periphery of the air flow plate and having an outlet formed for discharge of air; and the outer ring is spline coupled between a first hirth part of the first disk and a second hirth part of the second disk.

2. The disk assembly according to claim 1, wherein the plurality of passages are formed obliquely to a radial direction.

3. The disk assembly according to claim 2, wherein the plurality of passages are inclined at an angle of 40° to the radial direction.

4. The disk assembly according to claim 1, wherein partitions are each provided between the plurality of passages.

5. A disk for a compressor section of a gas turbine including a plurality of compressor stages, the disk comprising:

a root part configured to receive a rotary shaft in an axial direction;

a circular base plate extending radially from the root part and having an axial thickness less than an axial thickness of the root part;

a disk rim forming an outer periphery of the circular base plate and extending bidirectionally in the axial direction;

a circular hirth part radially disposed between the root part and the disk rim, the circular hirth part protruding from the base plate bidirectionally in the axial direction and comprising an axially facing surface and a plurality of grooves formed in the axially facing surface and circumferentially spaced apart from each other, the axially facing surface including a plurality of first surfaces arranged circumferentially around the axially facing surface and a plurality of second surfaces that are respectively interposed between the plurality of first surfaces and respectively form an axially recessed wall of the plurality of grooves; and at least one partition wall radially extending from the root part to the hirth part, wherein the disk rim and the circular hirth part are configured to form a first space radially disposed between the disk rim and the circular hirth part, and the circular hirth part and the root part are configured to form a second space radially disposed between the circular hirth part and a center of the disk, and wherein each of the plurality of first surfaces is configured to abut a corresponding one of a plurality of opposing first surfaces of a disk of an adjacent compressor stage of the plurality of compressor stages in order to block a flow of compressed air from the first space to the second space, and each of the plurality of second surfaces is configured to align with a corresponding one of a plurality of opposing second surfaces of the disk of the adjacent compressor stage in order to form an opening through which the compressed air may pass from the first space to the second space.

6. The disk according to claim 5, wherein the at least one partition wall consists of six partition walls.

7. The disk according to claim 5, wherein the at least one partition wall comprises a plurality of partition walls spaced circumferentially at equal intervals.

8. The disk according to claim 5, wherein the at least one partition wall has a longitudinal side extending an entire longitudinal length of the at least one partition wall, the longitudinal side disposed on an axially facing surface of the circular base plate and configured to block a circumferential flow of the compressed air in the second space.

9. The disk according to claim 8, wherein the at least one partition wall comprises an axially facing surface formed opposite the longitudinal side, the axially facing surface configured to block at least a portion of the circumferential flow of the compressed air in the second space.

10. The disk according to claim 9, wherein the axially facing surface includes a first portion communicating with the circular hirth part and a second portion communicating with the root part, the first portion configured to block the circumferential flow of the compressed air in the second space and the second portion configured to pass the circumferential flow of the compressed air in the second space.

11. The disk according to claim 5, wherein the at least one partition wall comprises a bonding portion communicating with the circular hirth part and having an axial height equal to a protruding height of the circular hirth part from the circular base plate.

12. The disk according to claim 5, wherein the at least one partition wall comprises an inclined portion communicating with the root part and including a radially outer end and a radially inner end, the radially outer end having an axial height that is equal to a protruding height of the circular hirth part from the circular base plate, the radially inner end having an axial height that is equal to a protruding height of the root part from the circular base plate, the inclined portion having a gradually reducing axial height from the radially outer end to the radially inner end.

13. The disk according to claim 5, wherein the at least one partition wall comprises a bonding portion and an inclined portion extending from the bonding portion, the bonding portion having an axial height equal to a protruding height of the circular hirth part from the circular base plate, the inclined portion having a gradually reducing axial height along a linear slope extending from the bonding portion to the root part.

14. The disk according to claim 5, wherein the circular hirth part has a protruding height from the base plate that is greater than a protruding height of either of the disk rim or the root part from the base plate.

15. The disk according to claim 5, wherein the root part includes an upper surface and an inclined surface communicating with the upper surface, the inclined surface abutting a correspondingly inclined surface of one end of the at least one partition wall.

16. The disk according to claim 15, wherein the at least one partition wall comprises an inclined portion having an axially facing surface communicating with the upper surface of the root part.

17. The disk according to claim 15, wherein the at least one partition wall has a longitudinal side extending from the circular hirth part to the inclined surface of the root part.

18. A disk assembly for a gas turbine compressor, comprising:

a first disk and a second disk disposed adjacent to the first disk, each of the first and second disks comprising a root part configured to receive a rotary shaft in an axial direction;

a circular base plate extending radially from the root part and having an axial thickness less than an axial thickness of the root part;

a disk rim forming an outer periphery of the circular base plate and extending bidirectionally in the axial direction; and a circular hirth part radially disposed between the root part and the disk rim, the circular hirth part protruding from the base plate bidirectionally in the axial direction and comprising an axially facing surface and a plurality of grooves formed in the axially facing surface and circumferentially spaced apart from each other, the axially facing surface including a plurality of first surfaces arranged circumferentially around the axially facing surface and a plurality of second surfaces that are respectively interposed between the plurality of first surfaces and respectively form an axially recessed wall of the plurality of grooves, wherein the first and second disks are coupled together such that the disk rim and the circular hirth part of the first disk form first and second spaces with the disk rim and the circular hirth part of the second disk, the first space radially disposed between the disk rims of the coupled first and second disks and the circular hirth parts of the coupled first and second disks, the second space radially disposed between the circular hirth parts of the coupled first and second disks and centers of the coupled first and second disks, and wherein each of the plurality of first surfaces of the first disk abuts a corresponding one of a plurality of opposing first surfaces of the second disk in order to block a flow of compressed air from the first space to the second space, and each of the plurality of second surfaces of the first disk aligns with a corresponding one of a plurality of opposing second surfaces of the second disk in order to form an opening through which the compressed air may pass from the first space to the second space.

19. The disk assembly according to claim 18, further comprising at least one partition wall radially extending from the root part to the hirth part of each of the first and second disks.

20. The disk assembly according to claim 19, wherein the at least one partition wall has a longitudinal side extending an entire longitudinal length of the at least one partition wall, the longitudinal side disposed on an axially facing surface of the circular base plate of either of the first and second disks and configured to block a circumferential flow of the compressed air in the second space, wherein the at least one partition wall comprises an axially facing surface formed opposite the longitudinal side, the axially facing surface configured to block at least a portion of the circumferential flow of the compressed air in the second space, and wherein the axially facing surface includes a first portion communicating with the circular hirth part of either of the first and second disks and a second portion communicating with the root part of either of the first and second disks, the first portion configured to block the circumferential flow of the compressed air in the second space and the second portion configured to pass the circumferential flow of the compressed air in the second space.

* * * * *